United States Patent [19]

Juraschek

[11] 4,259,380

[45] Mar. 31, 1981

[54] METHOD FOR RIGIDIFYING TEXTILE PIECES BY COATING WITH PLASTIC

[75] Inventor: Richard Juraschek, Vlotho, Fed. Rep. of Germany

[73] Assignee: Herbert Kannegiesser GmbH & Co., Vlotho, Fed. Rep. of Germany

[21] Appl. No.: 35,662

[22] Filed: May 3, 1979

[30] Foreign Application Priority Data

May 5, 1978 [DE] Fed. Rep. of Germany ..... 2819547

[51] Int. Cl.[3] ..... B05D 1/28

[52] U.S. Cl. ..... 427/428; 427/8; 427/365

[58] Field of Search ..... 427/8, 428, 365

[56] References Cited

U.S. PATENT DOCUMENTS 3,844,813 10/1974 Leonard et al. ..... 427/365 X

*Primary Examiner*—James R. Hoffman

*Attorney, Agent, or Firm*—Sughrue, Rothwell, Mion, Zinn and Macpeak

[57] ABSTRACT

A textile piece 10 to be coated with rigidizing plastic supplied by a compressing cylinder 12 is fed through a nip zone between the cylinder and a driven roller 16 by conveyors 15, 17. The compressing cylinder is mounted between pivotable levers 18, 19 counterweighted in one direction, and urged in the opposite direction to squeeze the fabric by a lateral array of pneumatic cylinders 21. The cylinders are individually controlled by a lateral array 13 of photocells which continuously sense the width of the incoming textile piece, whereby the nip zone force is automatically controlled as a function of fabric width to provide a uniform coating pressure on irregularly shaped or oriented textile pieces.

2 Claims, 4 Drawing Figures

METHOD FOR RIGIDIFYING TEXTILE PIECES BY COATING WITH PLASTIC

BACKGROUND OF THE INVENTION

This invention relates to a method and apparatus for rigidifying textile pieces of varying cross section for the production of outerwear clothing by coating same with plastic, in which the plastic is transferred into textile pieces lying one behind the other on a conveying device by means of a compressing cylinder bearing against the textile pieces during their coating.

In a known device (DTOS 2,552,878) the compressing cylinder is mounted above a pinch roller of the conveying device. The compressing cylinder or the pinch roller is height-adjustable, for the purpose of coating and non-coating portions of the textile pieces brought past it. The textile pieces can thus be coated either entirely or only partially during their conveyance. With regard to the quality of the coating of the textile pieces, it is important to control the pressure with which the compressing cylinder lies on the textile pieces in the course of the coating process. The pressure must be adapted both to the composition of the textile piece and to the degree of desired rigidification. If, for example, the plastic is to penetrate deeply into the textile surface structure, then the pressure must be greater than where the plastic should only adhere to the surface of the textile piece. The viscosity of the coating plastic must also be taken into consideration. The pressure exerted is primarily determined by the composition of the textile piece to be coated, the distance between the compressing cylinder and pinch roller, and the type of mounting of these elements during the coating process. The known device has no means for automatic, mechanical adaptation of the compressing cylinder force to changes in the textile pieces to be coated, for example between different blanks or when the blanks are lying irregularly or in a random position on the conveying device bringing them to the compressing cylinder for coating. But if these differences are present, then the textile pieces are coated by this known device with different pressures and thus different coating qualities, which is disadvantageous in several respects.

SUMMARY OF THE INVENTION

The basic purpose of the invention is to provide a method and an apparatus of the general type mentioned above wherein textile pieces, even those lying irregularly and in random positions behind and/or adjacent one another on the conveying device of the apparatus are coated by the compressing cylinder approximately equal pressure, specifically adapted to the circumstances (type of weave, coating depth, viscosity of the plastic, etc.).

According to the invention, the force with which the compressing cylinder lies on a textile piece is dependent on the width of the piece, as seen in the direction of conveyance, and is automatically and continuously mechanically adjusted, each textile piece thus being coated with approximately the same pressure, adapted to the circumstances (type of weave, coating depth, viscosity of the plastic, etc.). As a result all of the textile pieces are coated in the desired manner, and there are substantially no rejects.

DETAILED DESCRIPTION OF THE PREFERRED EMBODIMENTS

Figure 1:
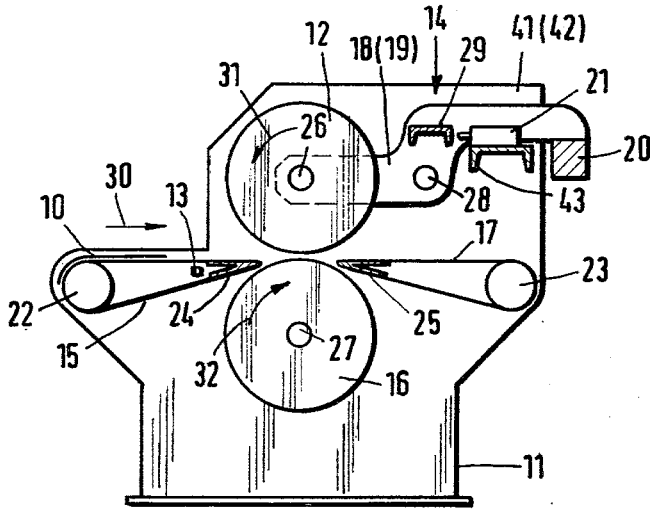
FIG. 1 shows a longitudinal section through the apparatus.
Figure 2:
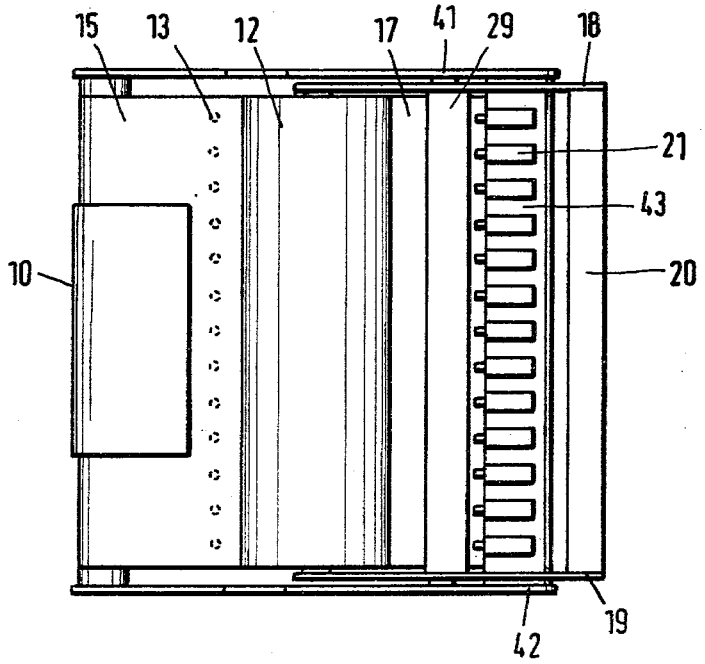
FIG. 2 shows a top view of the apparatus according to FIG. 1.
Figure 4:
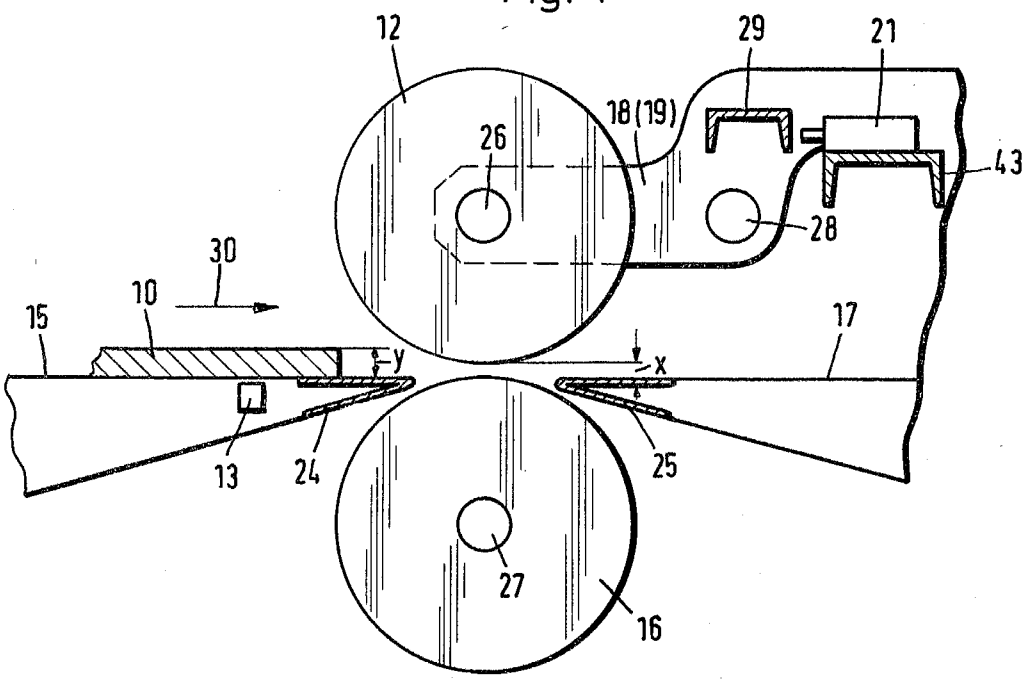
FIG. 4 shows an enlarged longitudinal section through a portion of FIG. 1.

The apparatus illustrated in FIGS. 1, 2 and 4 includes a frame 11 having side walls 41, 42. Transport belts 15, 17 and an intermediate roller 16 are mounted between the side walls 41, 42, with the axis 27 of roller 16 being in a form corresponding to its use. The conveying transport belts 15, 17 are guided over drive rollers 22, 23 and diverting plates 24, 25. The drive of the rollers 22, 23 and the roller 16 is accomplished in a known manner, not shown, the roller 16 being driven in the direction of arrow 32. Textile pieces or webs 10 placed on the transport belt 15 are conveyed in the direction of arrow 30. Advantageously, the roller 16 has a surface layer which plastic does not adhere to.

A compressing cylinder 12 and a device 14 for changing the distance between the compressing cylinder and the roller 16 are arranged above the conveying device. The compressing cylinder 12 can be formed as a deep or high pressure cylinder. The device 14 for changing the distance between the cylinder 12 and the roller 16 comprises two double-armed levers 18, 19 arranged at a distance from and parallel to each other, between which on one end the compressing cylinder 12 is mounted and on the other end a counterweight 20. The counterweight is arranged in such a manner that the compressing cylinder 12 is almost "weightless" or fully balanced in the normal position fixed by stops (not shown), i.e. at a distance from the roller 16 designated by "x" in FIG. 4. Other elements, such as springs, could also be used in place of the counterweight 20. The compressing cylinder 12 has an axis 26, the ends of which are mounted on the double-armed levers 18, 19. The levers are arranged on an axis 28, the ends of which are pivotably mounted on the side walls 41, 42 of the frame 11. A lateral support 29 is also mounted between the levers 18, 19 which has an abuttment surface for operating cylinders 21 mounted on a further lateral support 43 disposed between the side walls 41, 42 and attached thereto.

This arrangement for changing the distance between the compressing cylinder 12 and the roller 16 is particularly advantageous, but as an alternative the cylinder 12 can of course be stationary and the roller 16 can be arranged to be movable.

The compressing cylinder 12 is driven by known means, not shown, in the direction of arrow 31 at the same speed as the transport belts 15, 17 and the roller 16.

A detector array 13, which is coded in a binary manner, is arranged in the operating area of the transport belt 15 and parallel to the longitudinal axis of the compressing cylinder 12 to detect the width of the textile piece 10 to be coated. The detector array consists of a plurality of closely arranged, adjacent probe elements, such as photocells, and controls the operating cylinders 21 in a binary or decade system. Overall, the number of probe elements in the detector array 13 are coded in a binary manner with the goal of controlling a number of operating cylinders 21, either undetermined or ensuing from the system, according to a binary or decade system, selectively, such system being well known in electronic technology.

Figure 3:
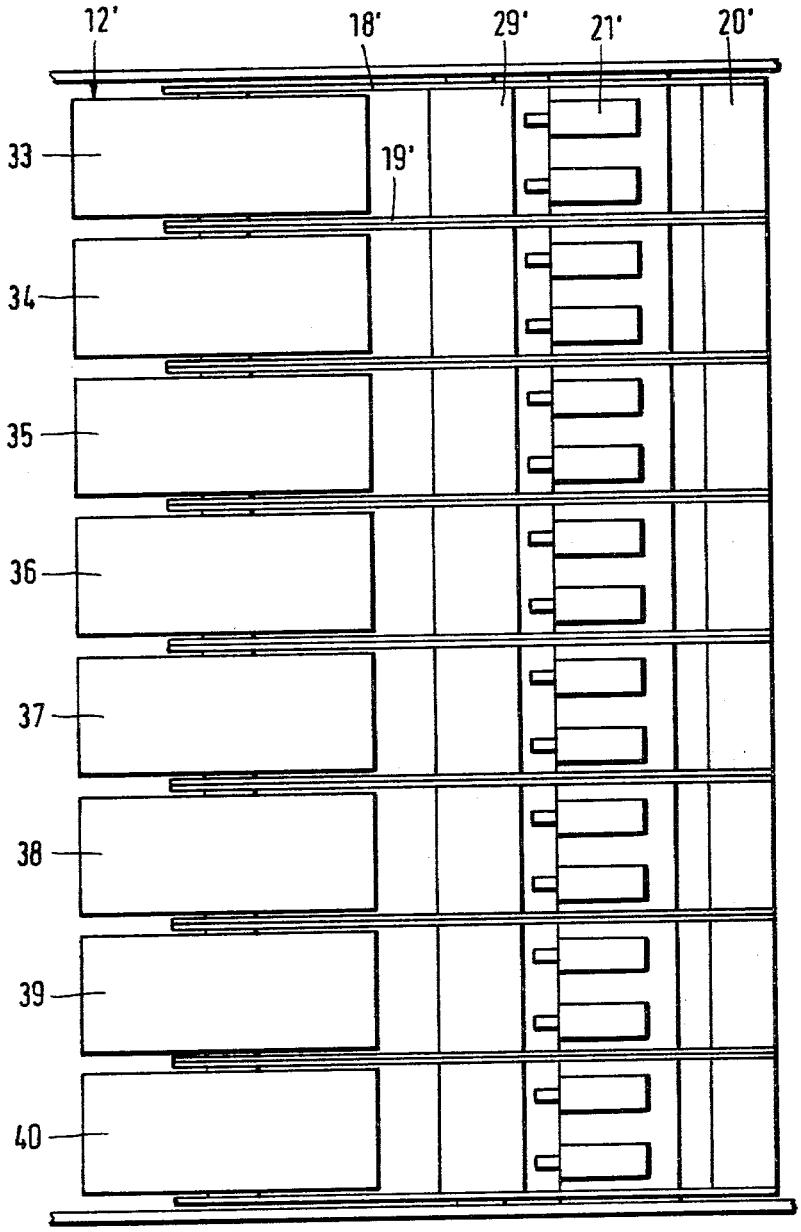
FIG. 3 shows an enlarged top view of the compressing cylinder and apparatus for changing the distance between the compressing cylinder and conveying device according to a modified embodiment.

The embodiment shown in FIG. 3 is a further development of the apparatus according to FIGS. 1 and 2, and has a compressing cylinder 12' which consists of a plurality of directly adjacent disc or small cylinder units 33 through 40, each mounted between two double-armed levers 18', 19' arranged at a distance from and parallel to each other. The arrangement of the levers 18', 19' is similar to that of the levers 18, 19 in the earlier embodiment. Each of the units 33 through 40 is associated with a counterweight 20' and two operating cylinders 21', as well as two or more of the probe elements of the detector array 13 shown in FIGS. 1 and 2. Each pair of levers 18', 19' also has a lateral support 29' with an abutment surface for the piston rods of the operating cylinders 21'. With this embodiment the apparatus may be divided into two or more adjacent operating areas, whereby it is adaptable to use with one feed path or a number of paths.

The further elements and parts necessary to complete and operate the apparatus are not illustrated in the drawings, because they are either known or obvious. Also not shown is the manner of coating of the textile pieces 10 and the detailed construction of the compressing cylinder 12 necessary with the use of a deep pressure method, or of the coating doctor blade necessary with the use of a high pressure method. It is also known to coat the textile pieces 10 in lines or stages, whereby the plastic is supplied to the compressing cylinder 12 in the form of a paste.

The method of operation of the apparatus according to FIGS. 1, 2 and 4 is as follows:

The textile piece 10 placed on the transport belt 15 of the apparatus by the operating person (not shown) is conveyed thereby in the direction of arrow 30 and first comes into the area of the detector array 13. In accordance with the number of photocells acted upon by the textile piece, the force with which the compressing cylinder 12 bears against the textile piece is adjusted during the course of the subseqeunt coating process. The adjustment takes place by action of the operating cylinders 21, which are activated by the photocell outputs. The adjustment process takes place completely automatically and is repeated for each further textile piece placed on the transport belt 15 and conveyed to the detector array 13 thereby. If a textile piece 10 is significantly nonsymmetrical, as seen in the conveying direction of the transport belt 15, then during the course of the coating the apparatus automatically performs a corresponding correction of the pressure, i.e. further operating cylinders 21 are activated or the activation of some operating cylinders 21 is ended. The activated operating cylinders 21 serve during the course of the coating of the textile piece as a restraining support for the compressing cylinder 12.

The activation of the operating cylinders 21 takes place by means of pressurized air fed to them by means of distributor lines (not shown), in which valves and pressure regulating units are incorporated. The valves are provided for turning the operating cylinders 21 on and off. The pressure regulating units are provided to adjust the pressure with which the operating cylinders 21 are activated and thus serve simultaneously to adjust the predetermined or specific pressure with which the compressing cylinder 12 lies on the textile piece during the coating process.

In FIG. 4 the front portion of the textile surface structure 10 to be coated has already been conveyed past the detector array 13 toward the compressing cylinder 12. Because the textile piece is thicker (dimension "y") than the distance "x" between the compressing cylinder 12 and the roller 16, it tends to raise the compressing cylinder as it passes into the nip zone. The control of the operating cylinders 21 by the activated photocells and the activation thereof by means of pressurized air is regulated to take place at the moment the front edge of the textile piece 10 reaches the nip zone.

In the embodiment of FIG. 3, the independent adjustment of the pressure of the individual units 33 through 40 of the compressing cylinder 12' is accomplished in a manner similar to that described in connection with FIGS. 1, 2 and 4.

I claim:

1. In a method of rigidifying outerwear pieces of textile material of different configurations for the production of clothing by coating them with plastic, wherein the textile pieces are serially fed in one behind the other on a transport conveyor, and the plastic is transferred onto the pieces by a compressing cylinder which bears against the textile pieces under pressure during the coating, the improvement characterized by:

(a) continuously sensing the width of each incoming textile piece in a direction transverse to the direction of delivery of the conveyor, and (b) automatically and continuously controlling the force with which the compressing cylinder bears against said each textile piece in direct proportion to the sensed width, whereby the greater the sensed width the greater the cylinder force, and vice versa, to thereby achieve a uniform coating pressure on each piece regardless of its shape or orientation.

2. Method according to claim 1, wherein adjustments of the cylinder force take place as the textile piece comes into contact with the compressing cylinder.

* * * * *